US007296729B2

(12) United States Patent
Erdie

(10) Patent No.: US 7,296,729 B2
(45) Date of Patent: Nov. 20, 2007

(54) END CAP FOR PAPER TUBE

(75) Inventor: Jason S. Erdie, Richfield, OH (US)

(73) Assignee: Erdie End Caps, LLC, Lorain, OH (US)

( * ) Notice: Subject to any disclaimer, the term of this patent is extended or adjusted under 35 U.S.C. 154(b) by 513 days.

(21) Appl. No.: 10/773,393

(22) Filed: Feb. 6, 2004

(65) Prior Publication Data

US 2005/0173504 A1 Aug. 11, 2005

(51) Int. Cl.
*B65D 43/06* (2006.01)

(52) U.S. Cl. ..... 229/125.17; 229/5.5; 229/125.27

(58) Field of Classification Search ..... 229/5.5, 229/93, 125.09, 125.17, 125.27
See application file for complete search history.

(56) References Cited

U.S. PATENT DOCUMENTS 2,049,379 A * 7/1936 Hosking ..... 229/125.17
2,346,685 A * 4/1944 Hothersall ..... 229/125.27
2,444,722 A * 7/1948 Bogoslowsky ..... 229/5.5
2,974,825 A * 3/1961 Ross ..... 229/5.5
3,106,328 A * 10/1963 Locke ..... 229/125.09
3,339,605 A * 9/1967 Ignell ..... 229/5.5
3,941,300 A * 3/1976 Troth ..... 229/5.5
4,042,169 A * 8/1977 Burgdorf ..... 229/125.17
4,438,864 A * 3/1984 Helms ..... 229/125.17

OTHER PUBLICATIONS

Western Container Corporation, Undated screen capture image from web page of "http://www.thomasregister.com/olc/70281001/snaplock.htm" showing "Snap Loc" pinched-end mailing/storage tubes.

* cited by examiner

*Primary Examiner*—Gary E Elkins
(74) *Attorney, Agent, or Firm*—Rankin, Hill, Porter & Clark LLP

(57) ABSTRACT

The present invention provides an end cap in combination with a paper tube. The paper tube has one or more inwardly extending flaps at an open end. The end cap has a bottom wall and a sidewall that extends from a peripheral edge of the bottom wall. The end cap receives and engages the inwardly extending flaps when the end cap is disposed in the open end of the paper tube.

20 Claims, 4 Drawing Sheets

FIG. 5
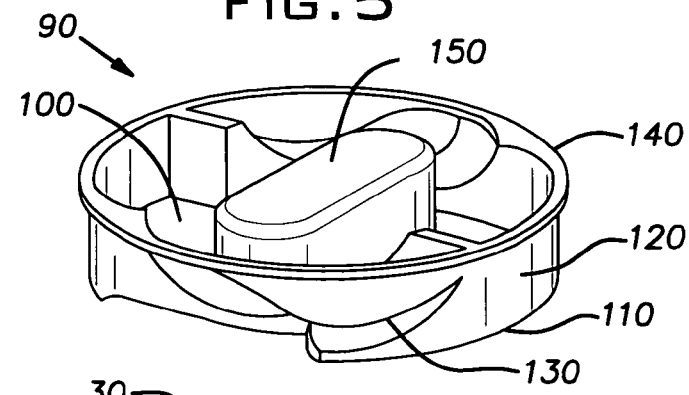
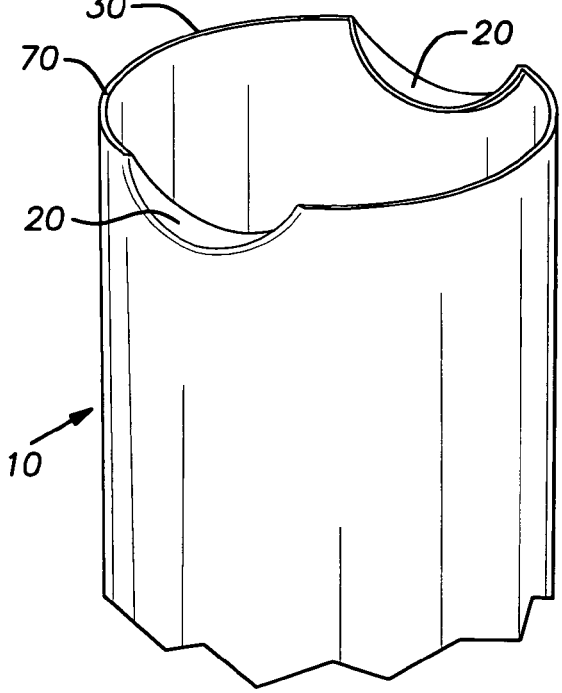
FIG. 7
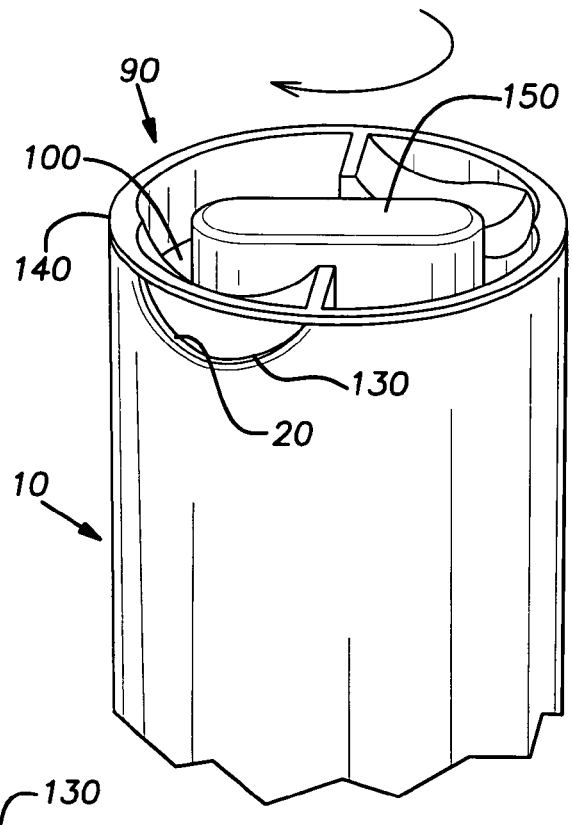
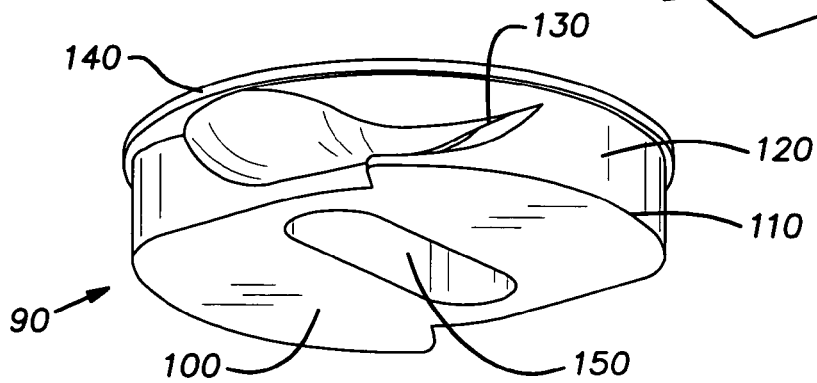
FIG. 6

END CAP FOR PAPER TUBE

BACKGROUND OF THE INVENTION

1. Field of Invention

The present invention relates to end caps for paper tubes, paper tubes having end caps connected thereto, and methods of closing an open end of a paper tube.

2. Description of Related Art

Paper tubes are conventionally formed by adhesively bonding two or more continuous strips of paper to each other in overlapping layers around a cylindrical mandrel and then cutting the paper cylinder or tube thus formed to desired length. The open ends of the paper tube can then be closed using a suitable end closure to form a container that is both light and strong.

A variety of end closures are known in the art for closing the open end of a paper tube. A very popular type is known in the industry as a plastic end cap or plug. Conventional plastic plugs include a bottom wall having a substantially circular peripheral edge and a sidewall that extends from the peripheral edge. In most cases, the plastic plug further comprises an annular flange that extends from the sidewall. The outer diameter of the flange is typically larger than the inner diameter of the paper tube and thus the flange acts as a stop or limiting rim that prohibits the plug from being pressed completely into the paper tube. The plug is retained in the end of the paper tube by a friction fit between outer surface of the sidewall and the inner surface of the paper tube. One or more ribs or ridges are sometimes formed on the outer surface of the sidewall to improve contact between the outer surface of the sidewall and the inner surface of the paper tube.

Plastic plugs are relatively simple to manufacture, inexpensive and lightweight. In addition, they can easily be inserted into and removed from an open end of a paper tube by hand. These features make plastic plugs particularly suitable for use forming mailing tubes or other similar shipping containers.

There are some drawbacks with the use of plastic plugs, however. Plastic plugs can sometimes "pop" out of one or both ends of the paper tube, which then allows the contents of the container to spill out. The plugs can "pop" out when the paper tube is squeezed or when the contents of the container shift during transit and strike the interior side of the bottom wall causing it to become dislodged from the paper tube.

Adhesive tape is sometimes applied over the plastic plug in an effort to insure that the plastic plug remains in the tube. Alternatively, staples are sometimes used to secure the plastic plug to the paper tube. Both of these solutions are disadvantageous because they can cause damage to the paper tube and/or the plastic plug and because they require additional time consuming steps or procedures. Moreover, use of adhesive or staples can damage the tube and/or end cap, which prevents reuse.

BRIEF SUMMARY OF THE INVENTION

The present invention provides an end cap in combination with a paper tube. The paper tube has one or more inwardly extending flaps at an open end. The end cap has a bottom wall and a sidewall that extends from a peripheral edge of the bottom wall. The end cap receives and engages the inwardly extending flaps when the end cap is disposed in the open end of the paper tube. In the preferred embodiment of the invention, the paper tube has a plurality of inwardly extending flaps at the open end and the sidewall of the end cap is provided with a plurality of channels for receiving and engaging the plurality of inwardly extending flaps when the end cap is disposed in the open end of the paper tube.

The present invention also provides a method of closing an open end of a paper tube using an end cap according to the invention. In accordance with the method, an inwardly extending flap is formed at the open end of the paper tube. The end cap is then inserted cap bottom wall first into the open end of the paper tube and then rotated relative to the paper tube until the inwardly extending flaps are received in and engaged by the channel. Preferably, the bottom wall of the end cap further comprises a projection for facilitating rotation of the end plug within the open end of the paper tube.

In an alternative embodiment of the method of the invention, the end cap is inserted into the paper tube before the inwardly extending flaps are formed at the open end of the paper tube. When the end cap is inserted into the paper tube bottom wall first, a portion of the sidewall proximal to the peripheral edge of the bottom wall circumferentially contacts the inner surface of the paper tube. The inwardly extending flaps are formed and then the end cap is rotated relative to the paper tube until the inwardly extending flaps are received in and engaged by the channels.

In yet another embodiment, the end cap is inserted into the paper tube before the inwardly extending flaps are formed at the open end of the paper tube. When the end cap is inserted into the paper tube bottom wall first, a portion of the sidewall proximal to the peripheral edge of the bottom wall circumferentially contacts the inner surface of the paper tube. The inwardly extending flaps are formed and then a wing extending from a top portion of the sidewall is bent downwardly and locked against an outer side of the inwardly extending flap.

The end cap and paper tube combination according to the invention is lightweight and very strong. The end cap can be inserted into the open end of the paper tube and secured thereto without the need for special tools. Furthermore, the end cap is very difficult to accidentally or unintentionally dislodge from the tube. However, it can be easily removed by hand and reused. No fasteners or adhesives need be used.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

BRIEF DESCRIPTION OF THE DRAWINGS

FIG. 5 is a perspective view of a first embodiment of an end cap and paper tube according to the invention.

FIG. 6 is a bottom perspective view of the end cap shown in FIG. 5.

FIG. 7 is a perspective view of the end cap connected to the paper tube as shown in FIG. 5.

DETAILED DESCRIPTION OF THE INVENTION

Figure 1:
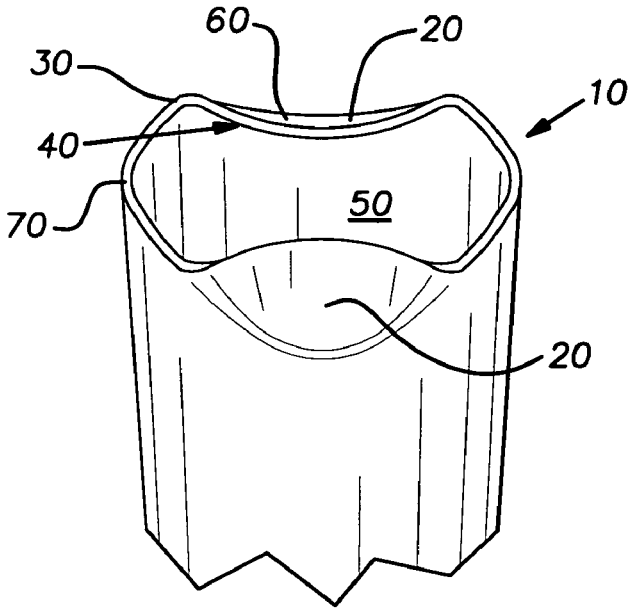
FIG. 1 is a perspective view of a paper tube having a pair of opposing inwardly extending flaps formed at an open end.

The present invention provides a combination comprising a paper tube and an end cap connected to an open end of the paper tube. With reference to FIG. 1, the paper tube 10 includes at least one and more preferably a plurality of inwardly extending flaps 20 at an open end 30. Each inwardly extending flap 20 has an inner side 40 that generally faces toward an interior portion 50 of the paper tube 10 and an outer side 60 that generally faces away from the interior portion 50 of the paper tube 10. The end cap is pressed into and received within the open end 30 of the paper tube 10 to close and seal the open end 30, thereby isolating the interior portion 50 from the outside of the paper tube 10. The end cap includes portions that contact and engage both the inner side 40 and the outer side 60 of the inwardly extending flaps 20.

Figure 2:
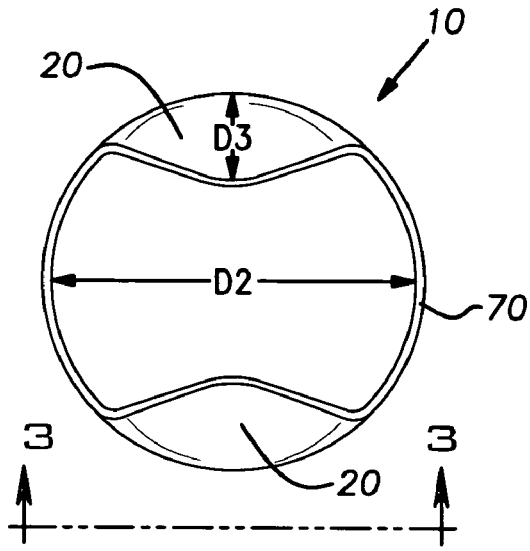
FIG. 2 is an end view of the paper tube shown in FIG. 1.
Figure 3:
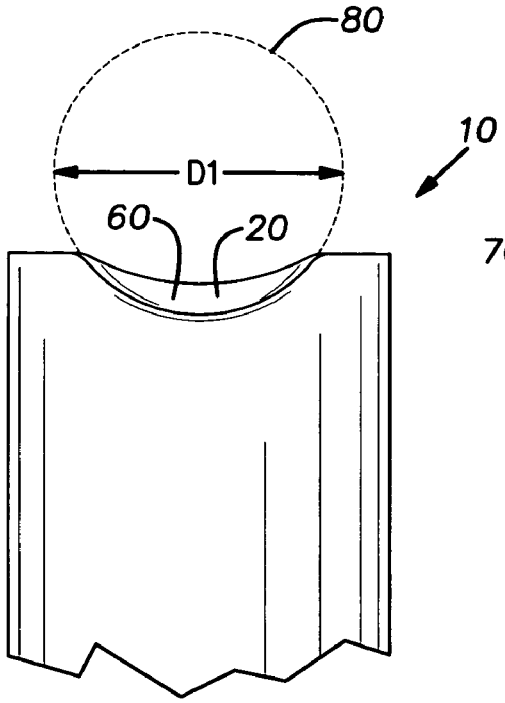
FIG. 3 is a side view of the paper tube shown in FIG. 2 as viewed in the direction shown by arrow III.
Figure 4:
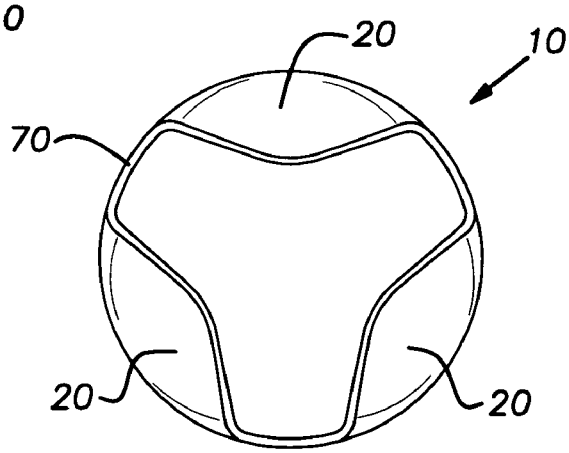
FIG. 4 is an end view of a paper tube having three inwardly extending flaps formed at an open end.

The inwardly extending flaps 20 are preferably formed by pressing and folding a top edge 70 of the open end 30 of the paper tube 10 inwardly toward the interior portion 50 of the paper tube 10. Depending upon the configuration of the end cap, the inwardly extending flaps 20 can either be formed before or after the end cap has been pressed into the open end 30 of the paper tube 10. A sizing die or pattern can be used to define the size and location of the inwardly extending flaps 20 or, alternatively, the inwardly extending flaps 20 can simply be formed using one's fingers. FIG. 2 shows an end view of a paper tube 10 having a pair of opposing inwardly extending flaps 20 formed at an open end 30. FIG. 3 shows a side view of the paper tube 10 shown in FIG. 2 as viewed in the direction shown by the arrow III. FIG. 4 shows an end view of a paper tube 10 having three inwardly extending flaps 20 formed at an open end 30.

With reference to FIGS. 2 and 3, applicant has found that the outer side 60 of the inwardly extending flap 20 will optimally define an arc of a circle 80 having a diameter D1 that is about one-half of the diameter D2 of the paper tube 10. The depth D3 of the inwardly extending flap 20 is not per se critical, but is preferably between about one-tenth to about one-sixth of the diameter D2 of the paper tube. A depth of about one-eighth of the diameter of the paper tube is presently considered optimal.

As will be shown in greater detail below, the end cap can be configured in various ways. For example, the end cap can comprise a single unit that has no moving parts. Alternatively, the end cap can comprise a single unit that does have moving parts. Or, the end cap can be formed from two or more pieces that are joined together. In all embodiments, however, the end cap includes a bottom wall having a peripheral edge and a sidewall that extends from the peripheral edge. At least a portion of the sidewall or peripheral edge must contact at least a portion of the inner wall of the paper tube. Furthermore, portions of the end cap must contact and engage both the inner side and the outer side of the inwardly extending flaps.

A first embodiment of the invention is shown in FIGS. 5 and 7. In this embodiment, the end cap 90, which is shown in FIG. 6, constitutes a single unit that has no moving parts. The end cap 90 comprises a bottom wall 100 having a peripheral edge 110 and a sidewall 120 that extends from the peripheral edge 110. The sidewall 120 includes a channel 130 or slit that is configured to receive and engage an inwardly extending flap 20 when the end cap 90 is disposed in the open end 30 of the paper tube 10. The end cap 90 further preferably comprises an annular flange 140 that extends from the sidewall 120. The annular flange 140 has an outer diameter that is larger than the diameter D2 of the paper tube 10 and thus operates as a stop or limiting surface that prevents the end cap 90 from being pressed too far within the paper tube 10.

In the embodiment illustrated in FIGS. 5 and 7, the inwardly extending flaps 20 are formed at the open end 30 of the paper tube 10 before the end cap 90 is pressed into the open end 30 of the paper tube 10. The peripheral edge 110 of the bottom wall 100 of the end cap 90 is not circular, but rather it is somewhat hourglass-shaped sufficiently to allow the end cap 90 to slide into the open end 30 of the paper tube 10 after the inwardly extending flaps 20 have been formed. The end cap 90 is pressed into the open end 30 of the paper tube 10 until the top edge 70 of the open end 30 of the paper tube 10 contacts the annular flange 140. With reference to FIG. 7, the end cap 90 is rotated in the direction of the arrow while disposed within the open end 30 of the paper tube 10 until the inwardly extending flaps 20 are received within the channel 130 and the end cap engages both the inner side 40 and the outer side 60 of the inwardly extending flaps 20. To assist in rotating the end cap 90, the bottom wall 100 includes a projection 150 that can be gripped using one's fingers.

Once the end cap 90 is inserted into the open end 30 of the paper tube 10 and rotated, the end cap 90 is very difficult to dislodge from the open end 30 of the paper tube 10. The end cap 90 is retained in the open end 30 of the paper tube 10 by the friction between the sidewall 120 and the inner wall of the paper tube 10 and by the mechanical lock formed between the inwardly extending flaps 20 that are trapped and engaged within the channel 130. The end cap 90 can be separated from the paper tube 10 simply by rotating the end cap 90 back to the first position and pulling the end cap 90 from the open end 30 of the paper tube 10.

In the embodiment of the invention illustrated in FIGS. 5 and 7, two opposing inwardly extending flaps 20 are formed at the open end 30 of the paper tube 10. It is much more difficult to dislodge an end cap 90 with channels 130 for receiving and engaging two opposing inwardly extending flaps 20 than it is to dislodge an end cap 90 having only one channel 130 for receiving and engaging one inwardly extending flap 20. End caps 90 provided with three channels 130 for receiving and engaging three inwardly extending flaps 20 are also very difficult to dislodge from the open end 30 of a paper tube 10. Although it is possible, it is somewhat difficult to form four or more inwardly extending flaps 20 at the open end 30 of a paper tube 10. Paper tubes having two or three inwardly extending flaps 20 formed at equally spaced intervals about the open end are therefore most preferred.

In order to improve the aesthetic appearance of the end cap and paper tube combination, the end cap can further optionally comprise a skirt that extends downwardly from the perimeter of the flange. The skirt is configured to contact an outer surface of the paper tube proximal to the open end. The skirt contacts the outer surface of the paper tube and thereby conceals the channels from view when the end cap is attached to the paper tube.

The present invention also provides a first method of closing an open end of a paper tube. The first method of the invention comprises forming an inwardly extending flap at an open end of a paper tube. Once the inwardly extending flap has been formed, an end cap having a bottom wall with a peripheral edge, a sidewall extending from the peripheral edge, and a channel formed in the sidewall is inserted bottom wall first into the open end of the paper tube. The end cap is then rotated relative to the paper tube until the inwardly extending flap is received in and engaged by the channel. More preferably, a plurality of inwardly extending flaps are formed at the open end of the paper tube, and each such inwardly extending flap is received in and engaged by a separate channel formed in the sidewall of the end cap.

Figure 8:
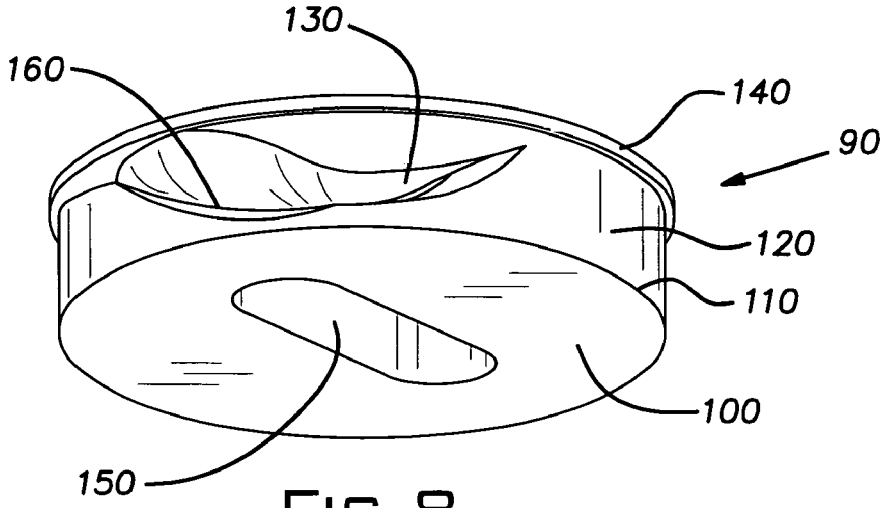
FIG. 8 is a bottom perspective view of a second embodiment of an end cap according to the invention.

FIG. 8 shows an exemplary end cap 90 for use in a second embodiment of the invention. In the second embodiment of the invention, the end cap 90 has a bottom wall 100 with a peripheral edge 110 that is substantially circular in shape. A sidewall 120 extends from the peripheral edge 110. The outer diameter of the sidewall 120 proximal to the peripheral edge 110 of the bottom wall 100 is equal to or slightly larger than the inner diameter D2 of the paper tube 10. Thus, at least the portion of the sidewall 120 that is proximal to the peripheral edge 110 of the bottom wall 100 of the end cap 90 circumferentially contacts and frictionally engages the inner wall of the paper tube 10 when the end cap 90 is pressed into and thus disposed in the open end 30 of the paper tube 10 bottom wall 100 first.

At least one and preferably a plurality of equally spaced recesses 160 or openings are formed in the sidewall 120 above the peripheral edge 110. The recesses 160 or openings define where the top edge 70 of the paper tube 10 should be inwardly pressed in order to form inwardly extending flaps 20. The recesses thus serve as forming dies for the inwardly extending flaps 20. One can form the inwardly extending flaps 20 simply by pressing the top edge 70 of the paper tube 10 inwardly with one's fingers against the recesses 160. A channel 130 or slit is formed in the sidewall 120 adjacent to each recess 160. Once the inwardly extending flap 20 is formed at the open end 30 of the paper tube 10, the end cap 90 is rotated relative to the paper tube 10 until the inwardly extending flap 20 is received and engaged within the corresponding channel 130 formed in the sidewall 120. As in the first embodiment, it is preferable for the end cap to include a plurality of recesses 160 and corresponding channels 130 or slits.

The present invention thus provides a second method of closing an open end of a paper tube. The second method comprises providing an end cap having a bottom wall having a peripheral edge and a sidewall extending from the peripheral edge. The sidewall must include at least one and preferably a plurality of recessed areas or opening for forming inwardly extending flaps at the open end of the paper tube when the end cap is disposed in the open end of the paper tube bottom wall first, and a t least one and preferably a plurality of channels adjacent to the recessed areas for receiving and engaging inwardly extending flaps. The end cap is inserted bottom wall first into the open end of a paper tube such that at least a portion of the sidewall proximal to the peripheral edge of the bottom wall circumferentially contacts an inner surface of the paper tube. Next, at least one and preferably a plurality of inwardly extending flaps are formed at the open end of the paper tube. The forming step can be accomplished by pressing the top edge of the paper tube into the recessed areas or openings. Next, the end cap is rotated relative to the paper tube until each inwardly extending flap is received in and engaged within the channel adjacent to the recessed area.

Figure 9:
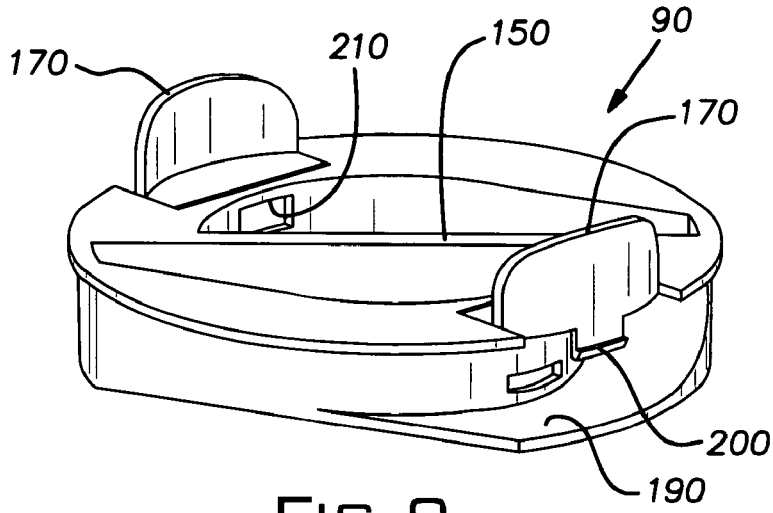
FIG. 9 is a perspective view of a third embodiment of an end cap according to the invention.
Figure 10:
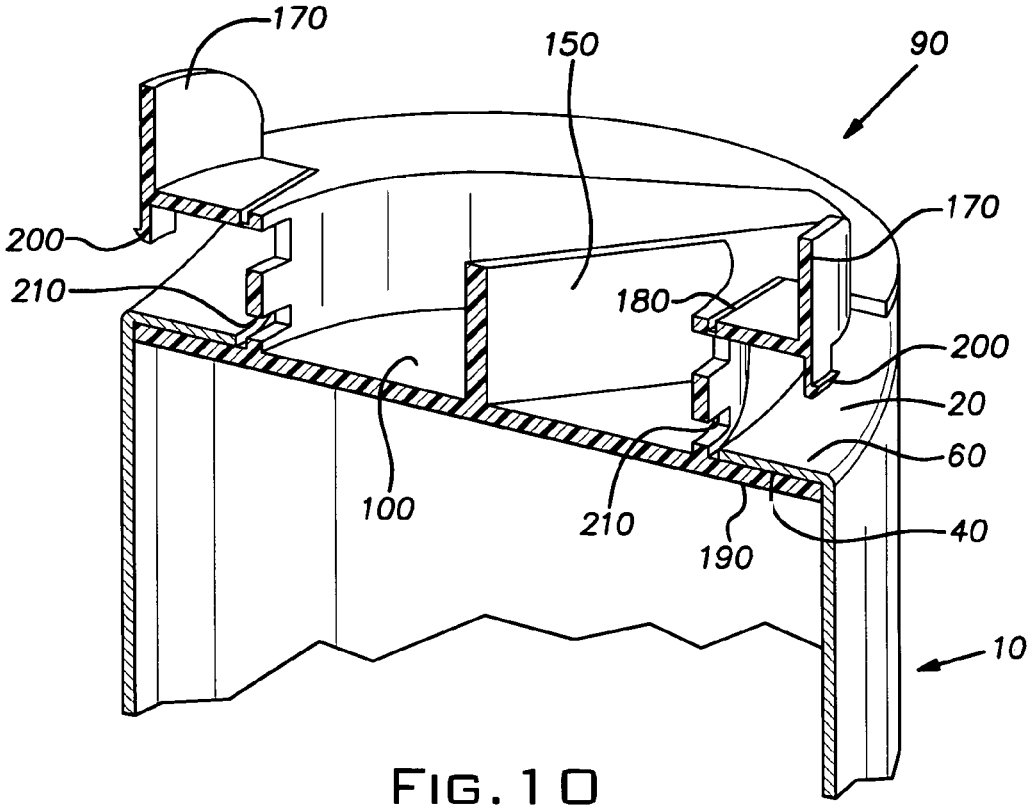
FIG. 10 is a sectional view of the end cap shown in FIG. 9 in contact with a paper tube.

FIG. 9 shows an exemplary end cap 90 for use in a third embodiment of the invention. In the third embodiment of the invention, the end cap 90 is a unitary structure that comprises a hinged wing 170 that extends from a top portion 180 of the sidewall 120. The hinged wing 170 is movable from a first position (shown in FIG. 9) where the hinged wing 170 does not contact the outer side 60 of the inwardly extending flap 20 to a second position where at least a portion of the hinged wing 170 does contact and engage the outer side 60 of the inwardly extending flap. FIG. 10 shows a sectional view of the end cap 90 shown in FIG. 9 disposed in the open end 30 of a paper tube 10 with the hinged wings 170 in a first position. The inwardly extending flaps 20 were formed at the open end 30 of the paper tube 10 before the end cap 90 was pressed into the open end 30 of the paper tube 10.

Figure 11:
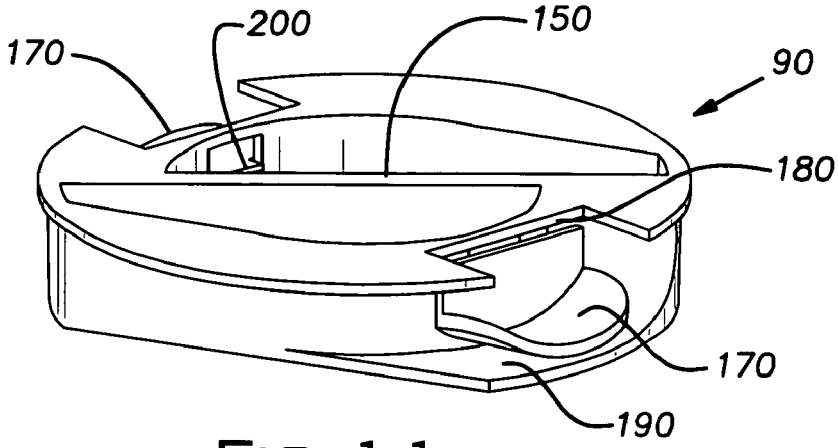
FIG. 11 is a detailed perspective view of the end cap shown in FIG. 9 with the hinged wings moved to a second position.

In the embodiment of the invention illustrated in FIGS. 9-11, the peripheral edge 110 of the bottom wall 100 of the end cap 90 is not circular, but rather it is somewhat hourglass-shaped sufficiently to allow the end cap 90 to slide into the open end 30 of the paper tube 10 after the inwardly extending flaps 20 have been formed. The end cap 90 is pressed into the open end 30 of the paper tube 10 until the top edge 70 of the open end 30 of the paper tube 10 contacts the annular flange 140. The end cap 90 has been rotated relative to the paper tube 10 such as described above with reference to FIG. 7 until the inner sides 40 of the inwardly extending flaps 20 are positioned above and in contact with a ledge 190 or base portion. Once the end cap 90 is inserted into the open end 30 of the paper tube 10 and rotated, the hinged wings 170 are moved to the second position (shown in FIG. 11, without the paper tube) where the hinged wings 170 press against the outer sides 60 of the inwardly extending flaps 20. The hinged wings 170 can be retained in the second position using a snap-fit locking barb 200 and corresponding opening 210 in the sidewall 120 of the end cap 90.

It will be appreciated that an end cap 90 such as shown in FIGS. 9-11 can alternatively have a peripheral edge 110 that contacts the inner surface of the paper tube, such as was previously described with respect to the second embodiment of the invention. However, when the peripheral edge 110 of the end cap 90 contacts the inner surface of the paper tube, the inwardly extending flaps 20 cannot be formed until after the end cap 90 has been pressed into the open end 30 of the paper tube 10. In such a configuration, the area below the hinged wings 170 and the ledge 190 serve as the recessed area 160 for use in forming the inwardly extending flaps 20. An end cap 90 having a peripheral edge that contacts the inner surface of the paper tube is inserted before the inwardly extending flaps are formed, and thus does not need to be rotated before the hinged wings 170 are moved from the first position to the second position, where the hinged wings 170 press against the outer sides 60 of the inwardly extending flaps 20. For this reason, paper tubes having shapes that are not circular in cross-section (e.g., tubes that are oval or triangular-shaped in cross-section) can be used.

The present invention thus provides third and fourth methods of closing an open end of a paper tube. In the third method, an end cap is pressed bottom wall first into an open end of a paper tube that has at least one and preferably a plurality of inwardly extending flaps formed at the open end.

The end cap is rotated until the inner side of the inwardly extending flap contacts (or is positioned above and thus contactable with) a ledge formed in the sidewall of the end cap. Next, a hinged wing extending from a top portion of the sidewall is moved from a first position where the hinged wing does not contact the outer side of the inwardly extending flap to a second position where at least a portion of the hinged wing does contact and engage the outer side of the inwardly extending flap.

In the fourth method of the invention, the end cap is pressed bottom wall first into the open end of the paper tube before any inwardly extending flaps have been formed. Once the end cap has been inserted into the open end of the paper tube, at least one and preferably a plurality of inwardly extending flaps are formed by pressing the top edge of the paper tube inwardly against the ledge formed in the end cap. Once an inwardly extending flap has been formed, a hinged wing extending from the top portion of the sidewall of the end cap is moved from a first position where the hinged wing does not contact the outer side of the inwardly extending flap to a second position where at least a portion of the hinged wing does contact and engage the outer side of the inwardly extending flap.

Figure 12:
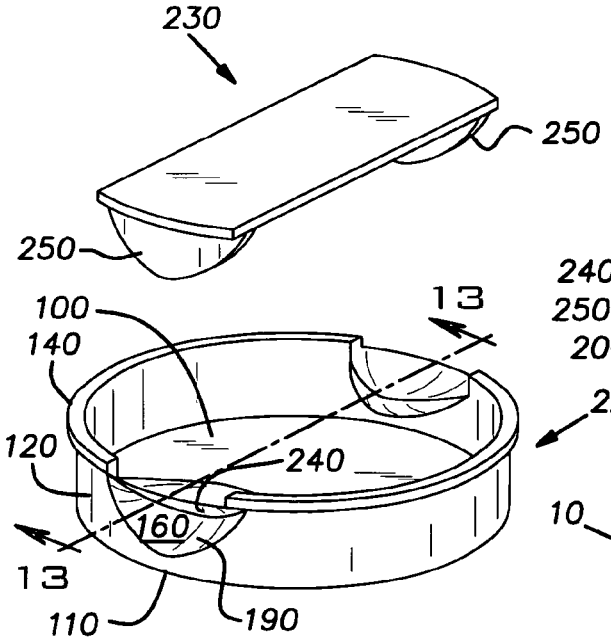
FIG. 12 is a perspective view of a fourth embodiment of an end cap according to the invention.

FIG. 12 shows a fourth embodiment of an end cap according to the invention. In this embodiment, the end cap comprises a first piece 220 and a second piece 230 that are joined together. The first piece 220 includes a bottom wall 100 having a substantially circular peripheral edge 110 and a sidewall 120 that extends from the peripheral edge 110. Two or more recesses 160 or openings are formed in the sidewall 120. Each recess 160 or opening includes a ledge 190 or base portion for contacting an inner side 40 of an inwardly extending flap 20 formed at an open end 30 of a paper tube 10. Each recess 160 also includes an angular top wall 240 positioned above the ledge 190. The second piece 230 includes a plurality of tangs 250 that are configured for snap-fit engagement in the plurality of recesses 160 or openings in the first piece 220. The first piece is preferably formed of plastic. The second piece 230 can be formed of plastic, but more preferably, is formed of metal.

Figure 13:
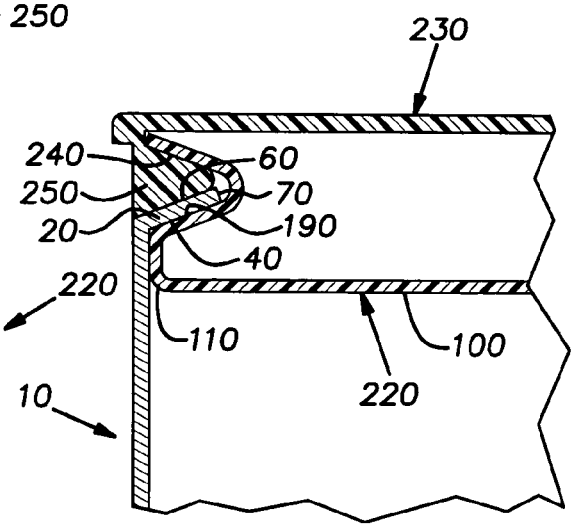
FIG. 13 is a detailed section view of the end cap show in FIG. 12 connected to a paper tube.

In this embodiment of the invention, the first piece 220 is pressed into the open end 30 of a paper tube 10 before any inwardly extending flaps 20 have been formed at the open end 30. Once the first piece 220 has been pressed into the open end 30 of the paper tube 10, at least two inwardly extending flaps 20 are formed at the open end 30 of the paper tube 10 by pressing a top edge 70 of the paper tube 10 inwardly at the recesses 160. The ledges 190 operate as forming dies for the inwardly extending flaps 20. The inner sides 40 of the inwardly extending flaps 20 are pressed into contact with the ledges 190. Next, the second piece 230 is disposed into contact with the first piece 220 such that the tangs 250 are pressed into the recesses 160, thereby capturing and engaging the inwardly extending flaps 20 between the tangs 250 and the ledges 190. The tangs 250 contact the outer sides 60 of the inwardly extending flaps 20 and the ledges 190 contact the inner sides 40 of the inwardly extending flaps 20. The tangs 250 also contact the angular top wall 240, which prevents the second piece 230 from being unintentionally removed from the first piece 220. FIG. 13 shows a close up sectional view of the engagement of the first piece 220, second piece 230 and inwardly extending flap 20 of a paper tube 10.

Thus the present invention provides end caps, combinations of end caps and paper tubes, methods of closing the open ends of paper tubes and paper tubes having end caps joined to the open end. The present invention is particularly useful for forming mailing tubes. The end caps of mailing tubes can be attached quickly and securely without the need for adhesives or staples, and can be removed and reused with relative ease.

End caps of mailing tubes formed in accordance with the invention are significantly more difficult to dislodge from the paper tubes. This is a substantial advantage during the shipment of goods. Conventional plastic plugs tend to "pop" out of paper tubes when a force of five or less pounds is applied (either pushing or pulling) against the plastic plug. End caps according to the invention, however, will not "pop" out until a force of about fifty pounds is applied against the plastic plug. Thus, end caps according to the invention are typically ten times more difficult to dislodge from paper tubes than conventional plastic plugs.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. An end cap in combination with a paper tube, wherein:
- the paper tube comprises a plurality of inwardly extending flaps at an open end; and
- the end cap comprises:
  - a bottom wall having a peripheral edge; and
  - a sidewall extending from the peripheral edge of the bottom wall;
- a plurality of channels are provided in the sidewall, each for receiving and engaging one of the plurality of inwardly extending flaps; and
- the end cap is adapted to be disposed within the open end of the paper tube such that it is selectively rotatable between:
  - a first position in which the plurality of inwardly extending flaps are not received and engaged in the plurality of channels when at least a part of the end cap is disposed within the open end; and
  - a second position in which the plurality of inwardly extending flaps are received and engaged in the plurality of channels.

2. The combination according to claim 1 wherein the end cap further comprises an annular flange that extends from the sidewall, the flange having an outer diameter that is larger than an inner diameter of the paper tube.

3. The combination according to claim 1 wherein the bottom wall of the end cap further comprises a projection for facilitating rotation of the end cap within the open end of the paper tube.

4. The combination according to claim 1 wherein:
- the paper tube has two opposing inwardly extending flaps at the open end; and
- the sidewall of the end cap is provided with two channels for receiving and engaging the two inwardly extending flaps when the end cap is disposed in the open end of the paper tube in the second position.

5. The combination according to claim 1 wherein:
- the paper tube has three equally spaced inwardly extending flaps at the open end; and
- the sidewall of the end cap is provided with three channels for receiving and engaging the three equally spaced inwardly extending flaps when the end cap is disposed in the open end of the paper tube in the second position.

6. The combination according to claim 1 wherein at least a portion of the sidewall proximal to the peripheral edge of the bottom wall circumferentially contacts an inner surface of the paper tube when the end cap is disposed in the open end of the paper tube.

7. A method of closing an open end of a paper tube comprising:

forming an inwardly extending flap at the open end of the paper tube;

providing an end cap comprising:

a bottom wall having a peripheral edge;

a sidewall extending from the peripheral edge of the bottom wall; and a channel provided in the sidewall for receiving and engaging the inwardly extending flap;

inserting the end cap bottom wall first into the open end of the paper tube; and rotating the end cap relative to the paper tube until the inwardly extending flap is received in and engaged by the channel.

8. The method according to claim 7 wherein the end cap further comprises an annular flange that extends from the sidewall, the flange having an outer diameter that is larger than an inner diameter of the paper tube.

9. The method according to claim 7 wherein the bottom wall of the end cap further comprises a projection for facilitating rotation of the end cap within the open end of the paper tube.

10. A method of closing an open end of a paper tube comprising:

providing an end cap comprising:

a bottom wall having a peripheral edge;

a sidewall extending from the peripheral edge of the bottom wall, the sidewall including a recessed area or opening for forming an inwardly extending flap at the open end of the paper tube when the end cap is disposed in the open end of the paper tube; and a channel provided in the sidewall for receiving and engaging the inwardly extending flap;

inserting the end cap bottom wall first into the open end of the paper tube such that a portion of the sidewall proximal to the peripheral edge of the bottom wall circumferentially contacts an inner surface of the paper tube;

forming the inwardly extending flap; and rotating the end cap relative to the paper tube until the inwardly extending flap is received in and engaged by the channel.

11. The method according to claim 10 wherein the end cap further comprises an annular flange that extends from the sidewall, the flange having an outer diameter that is larger than an inner diameter of the paper tube.

12. The method according to claim 10 wherein the bottom wall of the end cap further comprises a projection for facilitating rotation of the end cap within the open end of the paper tube.

13. An end cap for closing an open end of a paper tube having a plurality of inwardly extending flaps at the open end, the end cap comprising:

a bottom wall having a peripheral edge;

a sidewall extending from the peripheral edge of the bottom wall; and a plurality of channels provided in the sidewall each for receiving and engaging one of the plurality of inwardly extending flaps at the open end of the paper tube;

wherein the end cap is adapted to be disposed within the open end of the paper tube such that it is selectively rotatable between:

a first position in which the plurality of inwardly extending flaps are not received and engaged in the plurality of channels when at least a part of the end cap is disposed within the open end; and a second position in which the plurality of inwardly extending flaps are received and engaged in the plurality of channels.

14. The end cap according to claim 13 further comprising an annular flange that extends from the sidewall, the flange having an outer diameter that is larger than an inner diameter of the paper tube.

15. The end cap according to claim 13 further comprising a skirt that extends from the flange and contacts an outer surface of the paper tube proximal to the open end.

16. The end cap according to claim 13 wherein at least a portion of the channel has an arcuate contour.

17. A mailing tube comprising:

a paper tube having a plurality of inwardly extending flaps at a first end of the paper tube; and a plastic end cap releasably securable to the first end of the paper tube, the end cap comprising:

a bottom wall having a peripheral edge;

a sidewall extending from the peripheral edge of the bottom wall; and a plurality of channels provided in the sidewall for receiving and engaging the plurality of inwardly extending flaps;

wherein the plastic end cap is adapted to be disposed within the open end of the paper tube such that it is selectively rotatable between a first position in which the plurality of inwardly extending flaps are not received and engaged in the plurality of channels when at least a part of the end cap is disposed within the open end and a second position in which the plurality of inwardly extending flaps are received and engaged in the plurality of channels.

18. The mailing tube according to claim 17 wherein at least a portion of the sidewall proximal to the peripheral edge of the bottom wall circumferentially contacts an inner surface of the paper tube.

19. The mailing tube according to claim 17 wherein the end cap further comprises an annular flange that extends from the sidewall, the flange having an outer diameter that is larger than an inner diameter of the paper tube.

20. An end cap in combination with a paper tube, the combination comprising:

a paper tube having an inwardly extending flap at an open end, the inwardly extending flap having an inner side facing an interior portion of the paper tube and an outer side facing away from the interior portion of the paper tube; and an end cap comprising:

a bottom wall having a peripheral edge; and a sidewall extending from the peripheral edge of the bottom wall;

wherein the end cap receives and engages both the inner side and the outer side of the inwardly extending flap when the end cap is disposed in the open end of the paper tube, and wherein the end cap is a unitary structure that comprises a hinged wing extending from a top portion of the sidewall that can be moved from a first position where the hinged wing does not contact the inwardly extending flap to a second position where at least a portion of the hinged wing engages and contacts the outer side of the inwardly extending flap.

* * * * *